US007658291B2

(12) United States Patent
Valerio

(10) Patent No.: US 7,658,291 B2
(45) Date of Patent: Feb. 9, 2010

(54) METHOD AND APPARATUS FOR SORTING FINE NONFERROUS METALS AND INSULATED WIRE PIECES

(76) Inventor: Thomas A. Valerio, 3465 Hamilton Blvd., Atlanta, GA (US) 30354

( * ) Notice: Subject to any disclaimer, the term of this patent is extended or adjusted under 35 U.S.C. 154(b) by 0 days.

(21) Appl. No.: 11/732,285

(22) Filed: Apr. 2, 2007

(65) Prior Publication Data

US 2007/0262000 A1 Nov. 15, 2007

(51) Int. Cl.
*B07C 5/00* (2006.01)

(52) U.S. Cl. ..... 209/559; 209/44.2; 209/567; 209/644; 324/207.16; 324/228; 324/232

(58) Field of Classification Search ..... 209/44.2, 209/559, 567, 644; 324/207.16, 228, 232
See application file for complete search history.

(56) References Cited

U.S. PATENT DOCUMENTS 3,448,778 A 6/1969 Ramsay
3,568,839 A 3/1971 Dunlea
3,588,686 A 6/1971 Lingmann et al.
3,670,969 A 6/1972 Terada
3,701,419 A * 10/1972 Hutter et al. ..... 209/570
3,702,133 A * 11/1972 Vibert et al. ..... 209/214
4,557,386 A 12/1985 Buckley et al.
4,563,644 A * 1/1986 Lenander et al. ..... 324/232
4,576,286 A 3/1986 Buckley et al.
4,718,559 A 1/1988 Kenny et al.
4,724,384 A 2/1988 Castovilly et al.
4,848,590 A 7/1989 Kelly
4,940,187 A 7/1990 Lee
5,022,985 A 6/1991 Nugent
5,169,073 A 12/1992 Marabini
5,209,355 A 5/1993 Mindermann
5,260,576 A 11/1993 Sommer
5,273,166 A * 12/1993 Sawamura ..... 209/587
5,314,071 A 5/1994 Christian
5,344,026 A 9/1994 Booth et al.
5,413,222 A 5/1995 Holder
5,555,324 A 9/1996 Waxman et al.
5,555,984 A 9/1996 Sommer
5,632,381 A 5/1997 Thust et al.
5,667,151 A 9/1997 Miura et al.
5,801,530 A * 9/1998 Crosby et al. ..... 324/207.26
5,829,600 A 11/1998 Jordan et al.
6,100,488 A 8/2000 Satake et al.
6,112,903 A 9/2000 Kimmel
6,124,560 A 9/2000 Roos
6,144,004 A 11/2000 Doak (Continued)

OTHER PUBLICATIONS

International Search Report, PCT/US2007/008092, Feb. 11, 2008, 1 pp.

*Primary Examiner*—Patrick H Mackey
*Assistant Examiner*—Kalyanavenkateshware Kumar
(74) *Attorney, Agent, or Firm*—King & Spalding

(57) ABSTRACT

A system for sorting fine nonferrous metals and insulated copper wire from a batch of mixed fine nonferrous metals and insulated wire includes an array of inductive proximity detectors, a processing computer and a sorting mechanism. The inductive proximity detectors identify the location of the fine nonferrous metals and insulated copper wire. The processing computer instructs the sorting mechanism to place the fine nonferrous metals and insulated copper wire into a separate container than the non-metallic pieces.

8 Claims, 6 Drawing Sheets

U.S. PATENT DOCUMENTS

| | | | |
|---|---|---|---|
| 6,191,580 | B1 | 2/2001 | Guichard |
| 6,199,779 | B1 | 3/2001 | Mosher |
| 6,313,422 | B1 | 11/2001 | Anibas |
| 6,420,866 | B1 | 7/2002 | Goldberg et al. |
| 6,696,655 | B2 | 2/2004 | Harbeck et al. |
| 2001/0045378 | A1 | 11/2001 | Charles et al. |
| 2002/0074274 | A1 | 6/2002 | Pegga |
| 2004/0144693 | A1 | 7/2004 | Tse |

* cited by examiner

METHOD AND APPARATUS FOR SORTING FINE NONFERROUS METALS AND INSULATED WIRE PIECES

STATEMENT OF RELATED PATENT APPLICATIONS

This non-provisional patent application claims priority under 35 U.S.C. §119 to U.S. Provisional Patent Application No. 60/787,797, titled *Method and Apparatus for Sorting Fine Nonferrous Metals and Insulated Wire Pieces*, filed Mar. 31, 2006.

BACKGROUND

Recyclable metal accounts for a significant share of the solid waste generated. It is highly desirable to avoid disposing of metals in a landfill by recycling metal objects. In order to recycle metals from a mixed volume of waste, the metal pieces must be identified and then separated from the non-metallic pieces. Historically, fine pieces of stainless steel, aluminum/copper radiators, circuit boards, low conductive precious and semi-precious metals, lead, insulated wire and other nonconductive scrap smaller than 40 mm in size have not been recoverable. What is needed is a system that can separate fine pieces of stainless steel, aluminum/copper radiators, silver circuit boards, lead, insulated wire and other nonconductive scrap from other fine non-metallic materials.

SUMMARY OF THE INVENTION

The present invention is a system and device for sorting metal materials are smaller than 40 mm in size from a group of mixed material pieces of similar size. The metals separated by the system can include: stainless steel, aluminum/copper radiators, circuit boards, low conductive precious and semi-precious metals, lead, insulated wire and other nonconductive metals. The inventive system utilizes arrays of inductive proximity sensors to detect the target materials on a moving conveyor belt. The sensor arrays are coupled to a computer that tracks the movement of the target materials and instructs a separation unit to separate the target materials as the reach the end of the conveyor belt.

In an embodiment, the fine pieces of stainless steel, aluminum/copper radiators, circuit boards, low conductive precious and semi-precious metals, lead, insulated wire and other nonconductive scrap materials are placed on a thin conveyor belt that transports the pieces over an array of inductive proximity sensors. The inductive proximity sensors are arranged in one or more arrays across the width of the conveyor belt and the path of the materials. The sensors in the arrays are closely spaced but separated enough to avoid "cross talk" which causes detection interference between the adjacent sensors. The sensors may be separated across the width and also staggered along the length. This allows at least one of the sensors to detect target pieces that are positioned anywhere across the width of the conveyor belt. In addition to relative position, it is also possible to avoid cross talk by using sensors that operate at different frequencies and placing the different sensors adjacent to each other, possibly in an alternating pattern. With more sensors placed across the width, the system can more accurately determine the locations of the target pieces.

Each sensor array can be configured to detect a specific type of metal material. Different metal materials have different "correction factors." This allows some materials to be more easily detected by the inductive proximity sensors than other materials. Each array of sensors spans the width of the material travel path and is intended to detect a specific type of material. Each array can use sensors having multiple frequencies or separate staggered rows to avoid cross talk. It is also possible to have the sensors of multiple arrays mixed within a region of the material transportation system.

The inductive proximity sensors are positioned so that they face upward towards the upper surface of the conveyor belt. The sensors have a penetration distance which is the maximum distance that the sensor can detect a specific type of material. The penetration distance can range from less than 22 millimeters (mm) to greater than 40 mm. Different materials have different detection distances which are represented by a "correction factor." The correction factors may range from 0 to 1.0+. The detection range of a sensor is multiplied by the correction factor to determine the material detection range.

When the target pieces travel closely over the array of sensors, at least one of the sensors will generate an electrical signal. However, in some embodiments, it may be desirable to not detect some target materials. This can be achieved by controlling the depth of the sensors under conveyor belt. When the sensors are placed close to the conveyor belt surface, all sensors will detect all target materials. However, when the sensors are placed a distance under the surface, the sensors may detect materials having a high correction factor but not detect materials that have a lower correction factor. The system can be configured with multiple arrays of sensors that selectively detect, identify and distinguish different types of materials. For example, a first array of sensors may be placed close to the upper surface and a second array of sensors may be recessed below the surface. The first array detects all target materials and the second array only detects target materials having high correction factors. The system can then use this information to not only separate the target materials but also separate the high correction factor materials from the low correction factor materials.

A computer or other processor is coupled to the sensor arrays. The processor determines which sensor in the array detects the target piece and then correlates the position of the target materials across the width of the conveyor belt. The system also knows the speed of the conveyor belt and the distance between the sensors and the end of the conveyor belt. The time that a target piece reaches the end of the conveyor belt is determined by the distance divided by speed and the position of the target piece across the width is determined by the specific sensor detection in the array. The system will then predict when and where the piece will come to the end of the conveyor belt.

The computer uses the target material location information to control a sorting system. The computer instructs the sorting unit to selectively remove the piece at the detected width position at the predicted time. In an embodiment, the sorting system includes an array of air jets mounted at the end of the conveyor belt. When the fine stainless steel, aluminum/copper radiators, circuit boards, low conductive precious and semi-precious metals, lead, insulated wire and other nonconductive scrap pieces are detected, the computer synchronizes the actuation of the air jet with the time that the metal piece reaches the end of the conveyor belt. More specifically, one or more air jets corresponding to the position of the target piece are actuated to deflect the target piece as it falls off the conveyor belt. The target pieces are deflected into a separate recovery bin. The air jets are not actuated when non-metallic pieces reach the end of the conveyor belt and fall into a bin containing non-metallic pieces. The sorted fine nonconductive nonferrous metal piece and insulated wire pieces can then be recycled or resorted to separate the different types metals.

As discussed above, it is possible to selectively detect different types of target materials based upon their correction factors. In this type of a system, the force of the air jets may be controlled. While the non-metallic materials may fall into a scrap bin without any air jet actuation, the system may apply different air jet forces depending upon the type of material detected. For example, a low correction factor piece may get a low force air jet and be deflected into a first sorting bin while a high correction factor piece may be get a more powerful air jet and be deflected into a second sorting bin.

In alternative embodiments, multiple conveyor belt sorting systems can be used to perform multiple sortings based upon the different correction factor materials. The first sorting system may separate target metals from non-metals. The target metals may then be placed on a second conveyor belt and passed over a second array of sensors that selectively detect high correction factor materials. The system would then separate the high correction factor materials from the lower correction factor materials. Additional sorting can be performed as desired. This is more accurate sorting is helpful in segregating: steel, aluminum, copper and brass which makes recycling more efficient.

DETAILED DESCRIPTION

Figure 1:
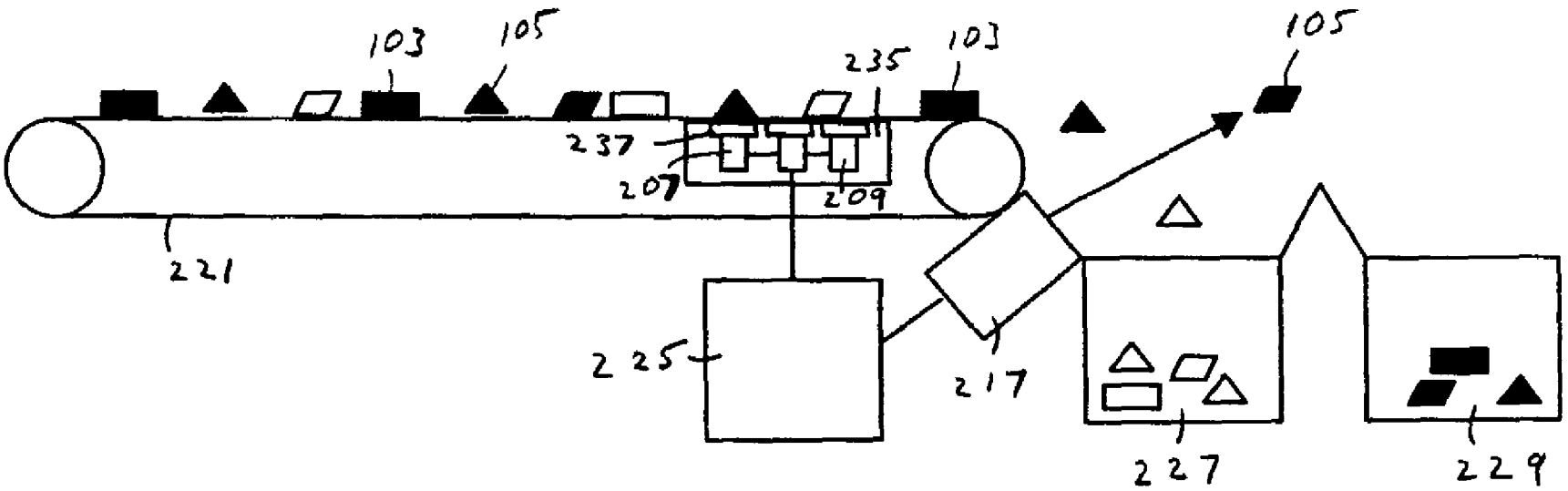
FIG. 1 is a single sort embodiment of the present invention.

Although the present invention is primarily directed towards a sorting system that utilizes inductive proximity sensors to identify and separate target metal pieces, there are other system components that are useful in optimizing the system performance. The mixed materials used by the inventive system are ideally small or fine pieces. These can come from various sources. In an embodiment, the mixed materials are emitted from a shredder and sorted by size with a trommel or another type of screening device that separates small pieces from larger pieces. In the preferred embodiment, pieces that are smaller than 40 mm (millimeters) are separated from pieces that are larger than 40 mm.

These fine pieces are further processed to separate the ferrous and conductive nonferrous materials. The mixed fine pieces can be passed over a magnetic separator that removes the magnetic ferrous materials. The fine nonferrous materials are then passed over an eddy current separator to remove the conductive nonferrous materials. Other metal sensors can be used to remove the other non-conducting metals that may have been missed by the eddy current device.

Various other processes can be performed to separate or prepare the remaining mixed materials for processing by the inventive system. For example, a density sorting device can be used to separate the lower density materials such as plastics, rubber and wood products from higher density glass and metals. An example of a density sorting system is a media flotation system, the pieces to be sorted are immersed in a fluid having a specific density such as water. The plastic and rubber may have a lower density and float to the top of the fluid, while the heavier metal and glass components with a higher density will sink.

After the ferrous and conductive nonferrous materials have been removed, the remaining fine nonconductive and nonferrous metal materials are passed by an array of sensors that can separate the nonferrous metals and insulated copper wire from the remaining materials. The sensors are able to detect the nonferrous metals including: stainless steel, aluminum/copper radiators, circuit boards, low conductive precious and semi-precious metals, lead and other nonconductive materials. In the preferred embodiment, these target pieces are between about 1 mm and 40 mm in size. The inventive system is a significant improvement over the prior art that has difficulty even detecting non-ferrous metal pieces that are less than 40 mm in size.

Other recycling systems detect and separate the metal pieces from the mixed material parts. As discussed in U.S. patent application Ser. No. 11/255,850, which is hereby incorporated by reference, the metal pieces are detected with inductive proximity detectors. The proximity detector comprises an oscillating circuit composed of a capacitance C in parallel with an inductance L that forms the detecting coil. An oscillating circuit is coupled through a resistance Rc to an oscillator generating an oscillating signal S1, the amplitude and frequency of which remain constant when a metal object is brought close to the detector. On the other hand, the inductance L is variable when a metal object is brought close to the detector, such that the oscillating circuit forced by the oscillator outputs a variable oscillating signal S2. It may also include an LC oscillating circuit insensitive to the approach of a metal object, or more generally a circuit with similar insensitivity and acting as a phase reference.

Oscillator is powered by a voltage V+ generated from a voltage source external to the detector and it excites the oscillating circuit with an oscillation with a frequency f significantly less than the critical frequency fc of the oscillating circuit. This critical frequency is defined as being the frequency at which the inductance of the oscillating circuit remains practically constant when a ferrous object is brought close to the detector. Since the oscillation of the oscillating circuit is forced by the oscillation of oscillator the result is that bringing a metal object close changes the phase of S2 with respect to S1. Since the frequency f is very much lower than the frequency fc, the inductance L increases with the approach of a ferrous object and reduces with the approach of a non-ferrous object. Inductive proximity sensors are described in more detail in U.S. Pat. No. 6,191,580 which is hereby incorporated by reference.

Different types of inductive proximity detectors are available which have specific operating characteristics. For example, high frequency unshielded inductive proximity sensors (~500 Hz up to 2,000 Hz) can detect fine nonferrous metals and insulated copper wire pieces. In an embodiment, the inductive proximity sensors used to detect the fine stainless steel, aluminum/copper radiators, circuit boards, low conductive precious and semi-precious metals, lead, insulated wire and other nonconductive scrap operates at a frequency of about 500 Hz and penetrate to 22 mm for increased detection resolution. The operating frequency corresponds to the detection time and operating speed of the metal detection. The faster operating frequency of 500 Hz allows the sensor to detect metal objects more quickly than a normal analog sensor. Because the high frequency sensors operate very quickly, they may generate more noise which results in output errors and possibly misfiring of the sorting system. Filters can be used to remove the noise, but the filters add additional components and degrade the fast operation of the high frequency sensors. In contrast, the analog sensors may collect data at a fast rage 0.5 milliseconds, but the data output is inherently filtered which averages of the detection signal and can provide a more reliable output.

Another distinction between the sensors is the penetration distance. The analog sensor may have a penetration distance of 40 mm while the high frequency sensor may have a penetration distance of 22 mm. The penetration distance is the distance that the sensor can detect target materials that have a 1.0 correction factor. Other differences between analog inductive proximity detectors and the custom high frequency inductive detectors are specified in Table 1 below.

TABLE 1

| | Analog Inductive Proximity Detector | High Frequency Inductive Proximity Detector |
|---|---|---|
| Operating Frequency | ~100 Hz | ~500 Hz |
| Resolution | ~25 mm at 2.5 mps | ~12 mm at 2.5 mps |
| Penetration | 40 mm | 22 mm |
| Diameter | ~30 mm | ~18 mm |
| Detection Time | ~10 ms per cycle | ~5 ms per cycle |

In an embodiment, the high frequency inductive proximity sensors are coil based and are able to accurately detect nonferrous metals such as aluminum, brass, zinc, magnesium, titanium, and copper. Although inductive proximity detectors can detect the presence of various types of metals, this ability can vary depending upon the sensor and the type of metal being detected.

The distinction in sensitivity to specific types of metals can be described in various ways. One example of the variation in sensitivity based upon the type of metal being detected is the correction factor. The inductive proximity sensors can have "correction factors" which quantifies the relative penetration distance for various metals. By knowing the base penetration distance is 22 mm and the correction factor of the metal being detected, the penetration distance for any metal being detected can be determined. Typical correction factors for fine nonferrous metals are listed below in Table 2.

TABLE 2

| METAL | CORRECTION FACTOR |
|---|---|
| Aluminum | 0.50 |
| Brass | 0.45 |
| Copper | 0.40 |
| Nickel-Chromium | 0.90 |
| Stainless Steel | 0.85 |
| Steel | 1.00 |

As discussed above, the high frequency inductive proximity sensor has a penetration rating of 22 mm and as shown in Table 2, the aluminum correction factor is 0.50. Thus, the penetration rating for aluminum would be the correction factor 0.50 multiplied by the penetration rating 22 mm. Thus, the penetration depth for aluminum for the detector is 11 mm.

In order to accurately detect the fine stainless steel, aluminum/copper radiators, circuit boards, low conductive precious and semi-precious metals, lead, insulated wire and other nonconductive scrap pieces mixed in with fine nonmetallics, the detectors must be placed in close proximity to these target materials. The mixed pieces are preferably distributed on a conveyor belt in a spaced apart manner so that the fine pieces are not stacked on top of each other and there is some space between the pieces. The batch of mixed materials is then moved over the array(s) of detectors that span the width of the conveyor belt. Because the detection range of the metal detectors is short, the inductive proximity sensors must be positioned close to each other so that all metal pieces passing across the array of sensors are detected. The fine pieces should not be able to pass between the sensors so as to not be detected.

With reference to FIG. 1, a side view of an embodiment of the inventive sorting system is shown. In order to quickly and accurately detect all of the fine nonferrous metals and insulated copper wire, the mixed fine materials pieces 103, 105 should be passed in close proximity to at least one of the first frequency sensors 207 or second frequency sensors 209. The conveyor belt 221 should be thin and not contain any carbon material so that sensors 207, 209 mounted in counter bore holes 237 in a sensor plate 235 under the conveyor belt 221. The conveyor belt 221 slides over the smooth upper planar surface sensor plate 235. The counter bore holes 237 allow the sensors 207, 209 to be mounted below the conveyor belt 221 so there is no physical contact. In the preferred embodiment, the conveyor belt 221 is made from a thin layer of urethane or urethane/polyvinyl chloride, which provides a non-slip surface for the mixed material pieces, and is about 0.9 mm to 2.5 mm thick depending on the desired penetration 103, 105. The belt preferably travels at a speed of about 0.9 meters per second (mps) to 4 mps depending on the desired resolution. A faster speed will require more accurate detection than a slower moving conveyor belt. The sensor plate 235 is preferably made of a wear resistant polymer with a high abrasion factor and low coefficient factor, such as polytetrafluoroethylene (Teflon) or a polycarbonate such as Lexan and is about 0.5 mm to 1.2 mm thick depending on the desired penetration.

Because the materials being sorted are small, the nonferrous metals and insulated copper wire 105 tend to lie flat on the conveyor belt 221 and will pass close to the inductive proximity sensor arrays 207, 209 mounted under and across the width of the conveyor belt 221. Because the fine stainless steel, aluminum/copper radiators, circuit boards, low conductive precious and semi-precious metals, lead, insulated wire and other nonconductive scrap pieces 105 are small, a large percentage of the available area will rest on the belt 221. In alternative embodiments, additional inductive proximity sensor arrays are placed above the conveyor belt 221 facing down onto the mixed fine materials 103, 105. These upper sensors 207, 209 can be arranged in the same manner as the sensors 207, 209 under the belt. All signals from the detectors 207, 209 are fed to a processing computer 225.

The detected positions of the fine stainless steel, aluminum/copper radiators, circuit boards, low conductive precious and semi-precious metals, lead, insulated wire and other nonconductive scrap 105 are fed to the computer 225. By knowing the positions of the fine stainless steel, aluminum/copper radiators, circuit boards, low conductive precious and semi-precious metals, lead, insulated wire and other nonconductive scrap 105 on the belt and the speed of the conveyor belt 221, the computer 211 can predict the position of the fine stainless steel, aluminum/copper radiators, circuit boards, low conductive precious and semi-precious metals, lead, insulated wire and other nonconductive scrap 105 at any time after detection. For example, the computer 225 can predict when and where a fine stainless steel, aluminum/copper radiators, circuit boards, low conductive precious and semi-precious metals, lead, insulated wire and other nonconductive scrap 105 will fall off the end of the conveyor belt 221. With this information, the computer 225 can then instruct the sorting mechanism to separate the fine stainless steel, aluminum/copper radiators, circuit boards, low conductive precious and semi-precious metals, lead, insulated wire and other nonconductive scrap 105 as it falls off the conveyor belt 221.

Various sorting mechanisms may be used. Again with reference to FIG. 1, an array of air jets 217 is mounted at the end of the conveyor belt 221. The array of air jets 217 is mounted under the end of the conveyor belt 221 and has multiple air jets mounted across the conveyor belt 221 width. The computer 225 tracks the position of the fine stainless steel, aluminum/copper radiators, circuit boards, low conductive precious and semi-precious metals, lead, insulated wire and other nonconductive scrap pieces 105 and transmits a control signal to actuate the individual air jet within the array 217 corresponding to the position of the fine stainless steel, aluminum/copper radiators, circuit boards, low conductive precious and semi-precious metals, lead, insulated wire and other nonconductive scrap 105 as they fall off the end of the conveyor belt 221. The air jets 217 deflect the fine stainless steel, aluminum/copper radiators, circuit boards, low conductive precious and semi-precious metals, lead, insulated wire and other nonconductive metal scrap 105 and cause them to fall into a metal collection bin 229. The air jets 217 are not actuated when non-metal pieces 103 come to the end of the conveyor belt 221 and fall off the end of the conveyor belt 221 into a non-metal collection bin 227.

Figure 2:
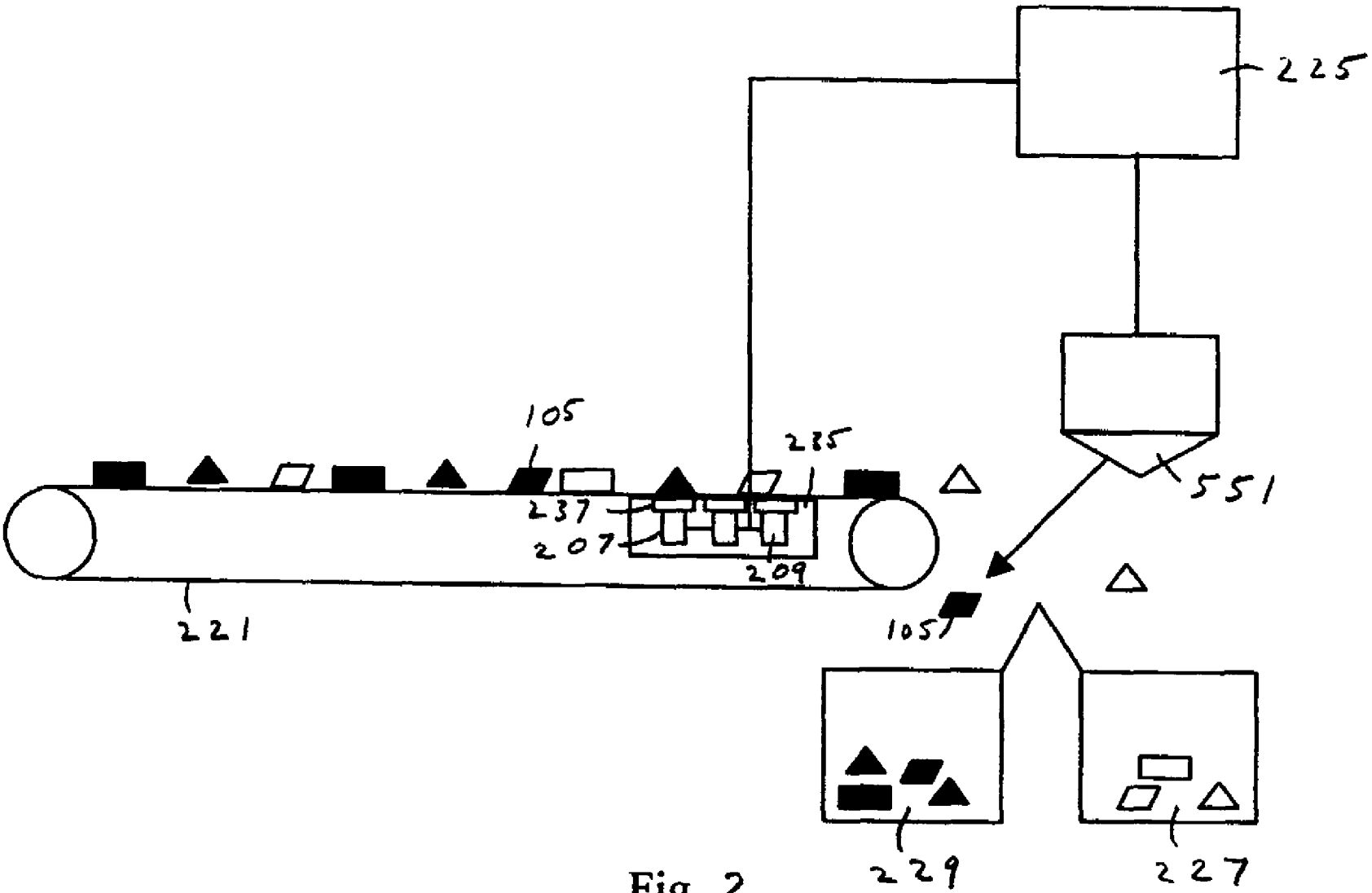
FIG. 2 is a single sort embodiment of the present invention.

It is also possible to have a similar sorting mechanism with an array of jets mounted over the conveyor belt. With reference to FIG. 2, an alternative sorting system includes an array of jets 551 mounted over the conveyor belt 221. The operation of this sorting system is similar to the system described with reference to FIG. 4. The difference between this alternative embodiment is that as the metal pieces 105 fall off the end of the conveyor belt 221, the computer 211 actuates the array of jets 551 to emit air jets 553 that are angled down to deflect the target metal pieces 105. This results in the metal pieces 105 being diverted into a first bin 229 for stainless steel, aluminum/copper radiators, circuit boards, low conductive precious and semi-precious metals, lead, insulated wire and other nonconductive metal scrap and a second bin 227 for all other materials.

Current air jets have operating characteristics that can cause inefficiency in the sorting system. Specifically, because the pieces come across the conveyor belt at high speed, the actuation of the air jets must be precisely controlled. Although the computer may actuate the air valve, there is a delay due to the valve's response time. A typical air valve is connected to 150 psi air and has a Cv of 1.5. While performance is constantly improving, the current characteristics are 6.5 milliseconds to open the air valve and 7.5 milliseconds to close the air valve. The computer can compensate for this delayed response time by calculating when the stainless steel, aluminum/copper radiators, circuit boards, low conductive precious and semi-precious metals, lead, insulated wire and other nonconductive scrap will reach the end of the conveyor belt and transmitting control signals that account for the delayed response time of the air valve. This adjustment can be done through computer software. For example, the signal to open the air valve is transmitted 6.5 milliseconds before the piece reaches the end of the conveyor belt and the signal to close the valve 7.5 milliseconds before the air jet should be stopped. With this technique, the sorting of the pieces will be more accurate. Future air valves will have an opening response time of 3.5 milliseconds and a closing response time of 4.5 milliseconds. As the response time of the air valves further improves, this off set in signal timing can be adjusted accordingly to preserve the timing accuracy.

Although the inventive metal sorting system has been described with an array of air jets mounted over or under the conveyor belt, it is contemplated that various other sorting mechanisms can be used. For example, an array of vacuum hoses may be positioned across the conveyor belt and the computer may actuate a specific vacuum tube as the metal pieces pass under the corresponding hose. Alternatively, an array of small bins may be placed under the end of the conveyor belt and when a stainless steel, aluminum/copper radiators, circuit boards, low conductive precious and semi-precious metals, lead, insulated wire and other nonconductive scrap piece is detected, the smaller bin may be placed in the falling path to catch the metal and then retracted. In this embodiment, all non-metal pieces would be allowed to fall into a lower bin. It is contemplated that any other sorting method can be used to separate the metal and non-metal pieces. Various other sorting mechanisms may be used.

Each sensor array is intended to detect a specific type of material. Because different types of metal have different correction factors, it is possible to distinguish the type of materials using multiple sensor arrays. Each sensor has a "detection area" which is the area that the sensor can detect a target material. The detection area is circular and emanates from the sensor in a conical volume. Thus, the detection area will expand with distance from the material transportation surface, however beyond a detection distance the sensor will not detect target materials. In order to properly cover the entire width of the material transportation surface, the detection areas of the sensors in the adjacent rows should be overlapped.

In the following examples, multiple sensor arrays are used to separate not only metal and non-metal pieces, but also different types of target metal materials. This is accomplished by using multiple sensor arrays having different settings. Each array is a group of sensors that are set to the same material detection properties. Although, the sensors within each array can be identical, it is also possible to mix different sensors within an array. For example, sensors can have different frequencies, operating characteristics (analog/digital), staggered spacing, etc and still be part of the same sensor array. It is also possible to position the sensors from different arrays within an overlapped region of the inventive system, so that one area of sensors can have sensors associated with multiple sensor arrays.

Figure 3:
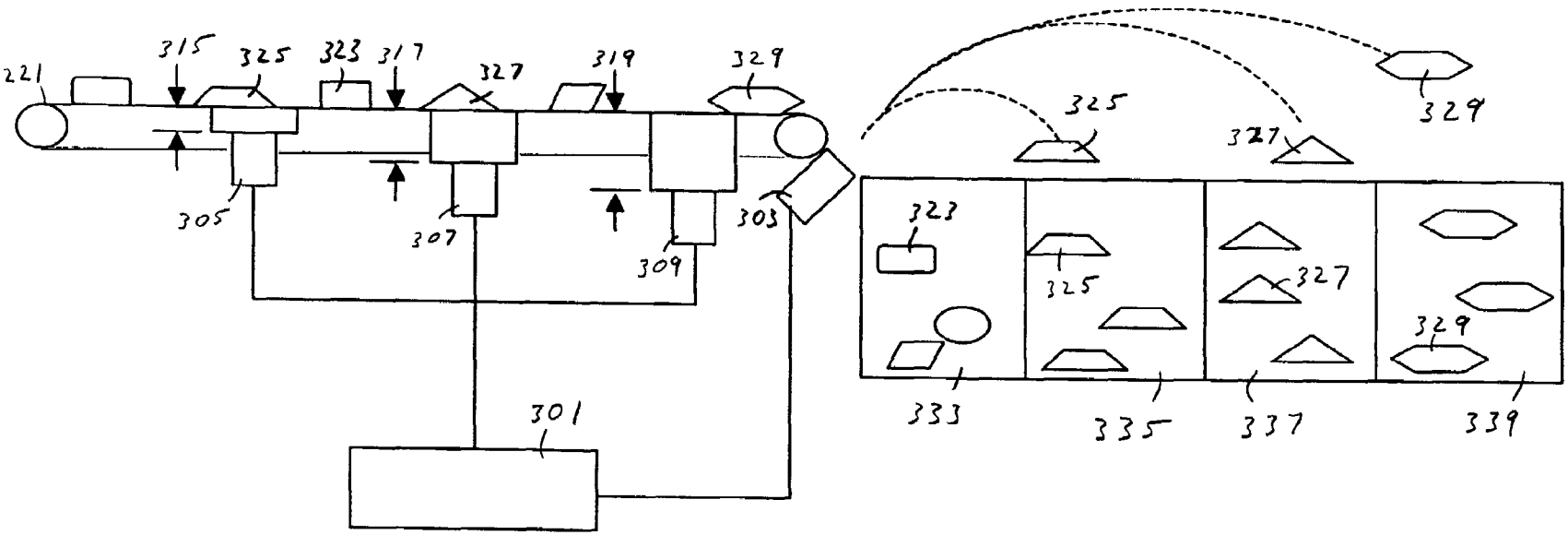
FIG. 3 is a multiple sort embodiment of the present invention.

With reference to FIG. 3, in an embodiment, the system has a plurality of inductive sensor arrays 305, 307, 309 that run across the width of the conveyor belt 221. The inductive sensors arrays 305, 307, 309 are also positioned at different depths 315, 317, 319 so that at least one array 305 will detect all targeted materials while one or more other arrays 307, 309 will only detect some materials that have a relatively high correction factor.

As discussed above in table 1, the penetration distance for a high frequency digital sensor is about 22 mm and the correction factors for the different materials listed in Table 2 range from 1.0 for steel to 0.40 copper. Thus, the correction factors cause the sensors to be more sensitive to some materials. By placing the sensors at a depth below the surface used to transport the mixed materials, the sensors can selectively detect different types of materials. For example, a sensor will be able to detect steel within a 22 mm penetration depth placed 10 mm under the material conveyor surface will only be able to detect steel, stainless steel and nickel chromium. The sensors will not be able to detect copper pieces because copper has a correction factor of 0.4. When multiplied by the penetration depth of 22 mm the range is reduced to 8.8 mm. Since the sensor is 10 mm below the copper pieces, it cannot detect copper. A listing of penetration depths for different materials and sensors is listed below in Table 3.

TABLE 3

| Material | Analog Sensor Detection Distance (40 mm) | Digital High Frequency Sensor Detection Distance (22 mm) |
|---|---|---|
| Aluminum | 20 mm | 11 mm |
| Brass | 18 mm | 9.9 mm |
| Copper | 16 mm | 8.8 mm |
| Nickel-Chromium | 36 mm | 19.8 mm |
| Stainless Steel | 34 mm | 18.7 mm |
| Steel | 40 mm | 22 mm |

The difference in sensitivity to different material can be used by the inventive system to sort the different types of target materials. In an embodiment, the analog and high frequency digital sensors can be used for different sensor arrays 305, 307, 309. In the inventive system, with reference to FIG. 3, the first array of high frequency digital sensors 305 are placed near the top of the conveyor belt 221, for example 5 mm below the surface 315. Because all materials listed in Table 2 have a correction factor of at least 0.40, the sensor penetration depth of the high frequency sensor is at least 8.8 mm. Since the first sensor array 221 is placed 5 mm 315 under the surface, it will be able to detect the presence of all listed materials. A second array of analog sensors 307 is placed 19 mm 317 below the surface. The second array 307 has a penetration depth of 40 mm and will be able to detect target pieces that have an analog sensor detection distance of 19 mm or greater.

Another way to determine the position of the sensors is by correction factor. By placing the analog sensors 19 mm below the conveyor belt surface, the sensors will only detect materials that have a correction factor greater than 0.475. This correction value transition point is calculated by 19 mm (distance)/40 mm (penetration)=0.475 correction factor. The materials that are detectable by the second array include: aluminum, nickel-chromium, stainless steel and steel.

The third array 309 may use high frequency digital sensors and may be placed 15 mm 319 under the conveyor belt surface. The high frequency sensors will be able to detect nickel-chromium, stainless steel and steel which all have sensor detection distances greater than 15 mm and correction factors greater than 0.68. The correction factor transition point is calculated by 15 mm distance/22 mm penetration=0.68 correction factor.

The sensor arrays 305, 307, 309 are coupled to a computer 301 that determines the type of material and determines when the target materials will reach the end of the conveyor belt. In this configuration, the target pieces may be detected by some sensor arrays 305, 307, 309 but not all arrays. The summary of the sensor array 305, 307, 309 detection is summarized in Table 4.

TABLE 4

| Material | First Array High Frequency Digital | Second Array Analog | Third Array High Frequency Digital |
|---|---|---|---|
| Aluminum | Detected | Detected | Not Detected |
| Brass | Detected | Not Detected | Not Detected |
| Copper | Detected | Not Detected | Not Detected |
| Nickel-Chromium | Detected | Detected | Detected |
| Stainless Steel | Detected | Detected | Detected |
| Steel | Detected | Detected | Detected |
| Non-Target Materials | Not Detected | Not Detected | Not Detected |

Because the computer 301 is coupled to each sensor array 305, 307, 309, it can narrow the type of material to a small group or identify the material based upon the sensor arrays 305, 307, 309 that detect the material. The computer 301 can use the sensor array 305, 307, 309 information to instruct the sorting unit to separate each group of identified materials into separate sorting bins 333, 335, 337, 339. In an embodiment, materials 323 that are not detected by any of the sensor arrays 305, 307, 309 are not target metal materials. Because these materials 323 are not detected they will fall off the conveyor belt into a first bin 333. Material pieces that are detected by only the first array 305 are limited to brass or copper 325 and may be deflected by the air jet array 303 into a second bin 335. Pieces that are detected by both the first and second arrays 305, 307 can only be aluminum 327 which is deflected into a third bin 337. Pieces that are detected by all three sensor arrays 305, 307, 309 are either nickel-chromium, stainless steel or steel pieces 329 that are deflected into a fourth bin 339.

Figure 4:
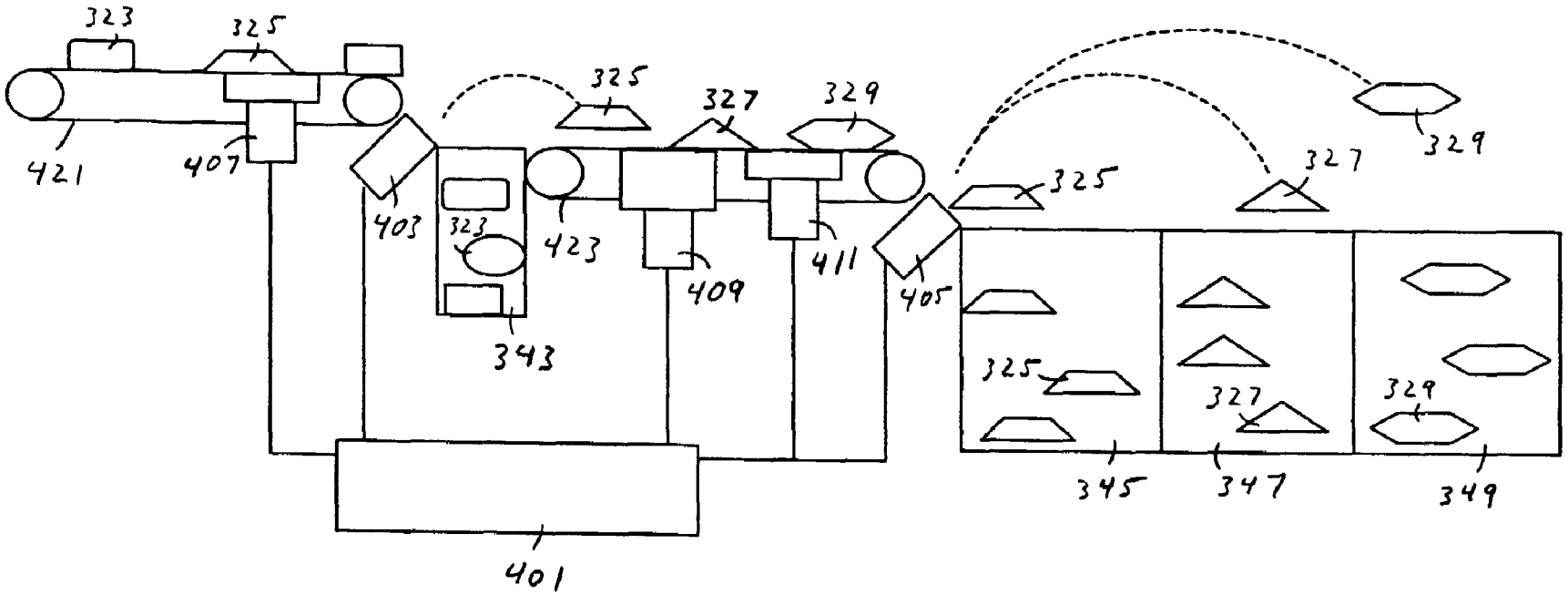
FIG. 4 is a multiple belt and multiple sort embodiment of the present invention.

Although it may be more efficient to have a single conveyor belt system that sorts pieces into many different types of materials, it may be more accurate to use multiple conveyor belts to simply the sorting unit requirements. With reference to FIG. 4, a system that utilizes two conveyor belts 421, 423 is illustrated. In this embodiment, a high frequency array of sensors 407 is used in the first conveyor belt 421 to separate all target metal pieces 325, 327, 329 from the non-target pieces 323. The non-target pieces 323 fall into a first bin 333 while the target metal pieces 325, 327, 329 are detected and deflected by the first sorting system 403 onto a second conveyor belt 423. The second conveyor belt 423 has a second array 409 and a third array 411 of sensors. These may both be analog sensor arrays that are set at depths of 17 mm and 38 mm, respectively. The computer 401 can instruct the second sorting unit 405 to separate the parts 345, 347, 349 based upon these transition points. The target pieces 325 such as copper that have a detection distance of 16 mm or less will fall into the second bin 345. The pieces 327 that have a detection distance between 17 and 38, brass, copper, nickel-chromium and stainless steel can be deflected into the third bin 347. The steel pieces that have a detection distance greater than 38 are detected by both the second and third array of sensors are deflected into the fourth bin.

While two examples have been described, various other configurations are possible. The system may include any number of conveyor belts may be used with any number of sensor arrays. For example, since there are six types of materials, the inventive system may include six conveyor belts that each have one array of sensors. In this embodiment, the first sensor may separate non-target materials, the second sensor may separate steel, the third may separate stainless steel, etc. By only having a single sensor per conveyor belt, the separation unit operation is simplified since it only has a single jet force when actuated. Although the system has been described as using each array to distinguish each different type of target material, it is also possible to have redundant sensor arrays that have the same or similar switch points to improve system accuracy. In some cases, different sensors are better at detecting different shapes or sizes of target materials. For example, a high frequency sensor may detect smaller target materials because it is able to take many samples in a short period of time, however the high frequency may also result in more noise errors. By running a lower frequency analog array and a high frequency digital array at the same switch point, the detection of the target materials in the sensor range might be improved.

Although the sensors are disclosed as having a fixed penetration distance, these values may vary or shift depending upon the operating conditions, the type of sensor or manufacturing variations. Because the penetration distance may not uniform, it may be desirable to have an adjustable sensor position. As discussed above, the sensors are placed at specific distances below the upper surface of the conveyor belt typically in a counter bored hole. In an embodiment, the sensor is threaded or mounted in a threaded cylinder and the counter bored holes have corresponding threads. Each sensor is adjustable by screwing the sensor in or out of the threaded hole. Various other sensor adjustment methods and mechanisms can be used including: micro adjusting linear actuators, shims, adjustable friction devices, etc.

In an embodiment, the inventive system has a calibration procedure in which the sensor positions are adjusted to provide a uniform output for a given target material. A reference target piece is placed over each sensor in the array in the same relative position and the output of the sensor is checked for uniformity. Alternatively, a test pattern of test materials may be passed over the sensor arrays in a specific manner. The individual sensors are adjusted so that the proper output is obtained from each.

In an embodiment, it maybe necessary to perform calibration of the sensors. Because the outputs for analog and digital devices are substantially different individual calibration procedures might be required for each. For an analog device, the output can be a voltage within a specific range such as 0 to 10 volts or current ranging from 4 to 20 milli Amps. The analog sensors are adjusted so that the outputs for a calibration object is within a narrow acceptable range. Multiple calibration objects can be used. In contrast, a digital sensor will be switched on or off in response to a target object. The calibration method may require separate "on" and "off" calibration objects that are similar. If the "on" and "off" calibration objects are very similar the digital sensors will be more uniform in output. During testing, the sensors must be adjusted so that they switch on when the on calibration object is used and off when the off calibration object is used. Once all the sensors are calibrated, the system should perform with a high level of uniform selectivity. The described calibration process may need to be repeated as the system and sensors may fluctuate over time.

Although it is desirable to place the sensors close to each other this close proximity may result in "cross talk" which is a condition in which detection signals that are intended to be detected by only one sensor may detected by other adjacent detectors. The result can include sensor location and sorting errors that result in sorting errors. The computer separate both the target and the improperly targeted pieces as they reach the end of the conveyor belt. There are various methods for avoiding the cross talk between the detectors while monitoring the entire width of the conveyor belt.

Figure 5:
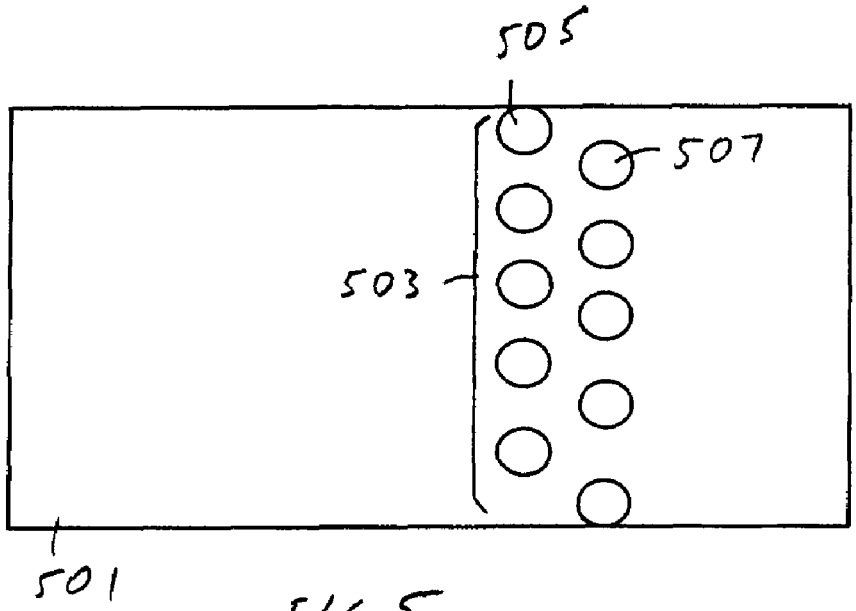
FIG. 5 is a top view of a staggered sensor array.

Cross talk can only occur between sensors operating at the same frequency. In the preferred embodiment, cross talk is avoided by spacing the sensors away from each other. With reference to FIG. 5, an array of sensors 503 is illustrated that spans the width of a conveyor belt 501 includes first row of sensors 505 that are uniformly spaced apart from each other and a second parallel row of sensors 507 that are offset from the first row of sensors 505. Thus, the detection areas of the 500 Hz sensors can be placed in an overlapping position without cross talk. This allows the sensors in each row to be very closely spaced across the width of the parts path.

Figure 6:
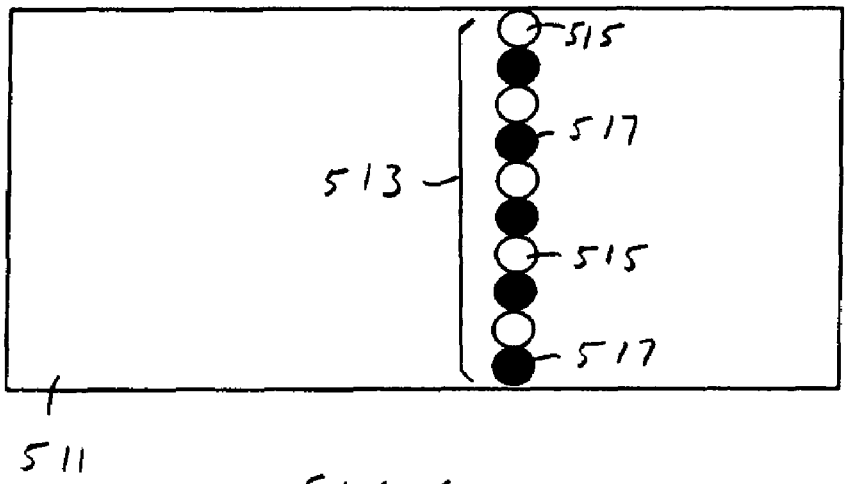
FIG. 6 is a top view of a mixed frequency sensor array.

In other embodiments, it is possible to use sensors that operate at two or more frequencies. Cross talk may occur between sensors that have detection area overlap and are operating at the same frequency. If sensors having different frequencies are mixed within the array, it is possible to sufficiently separate the sensors that operate at the same frequency to avoid cross talk. With reference to FIG. 6, an array of sensors 513 spans the width of the conveyor belt 511. Since the adjacent sensors 515, 517 operate at different frequencies they many be placed close together. The first frequency sensors 515 are sufficiently separated and similarly the second frequency sensors 517 are sufficiently separated to prevent cross talk.

In other embodiments, the array can include sensors operating at multiple frequencies and sensors that are staggered across the belt so that sensors are located across the entire width, but are separated from each other. For example, an array can include a first set of sensors operates at a first frequency, a second set of sensors operates at a second frequency, and a third set of sensors operates at a third frequency. These different sensors can be configured in an alternating pattern across the width of the conveyor belt. By using different frequencies and/or using multiple staggered rows of sensors, fine stainless steel, aluminum/copper radiators, circuit boards, low conductive precious and semi-precious metals, lead, insulated wire and other nonconductive scrap can be detected at any point across the width of the conveyor belt. Although the system has been described with separate arrays of sensors, it is possible to mix the sensors set at different depths and different types and frequencies all within one or more strips that span the width of the conveyor belt. Although the wiring of this type of a mixed system will be complicated, it will have the benefit of placing dissimilar sensors in close proximity so that cross talk is minimized.

Figure 7:
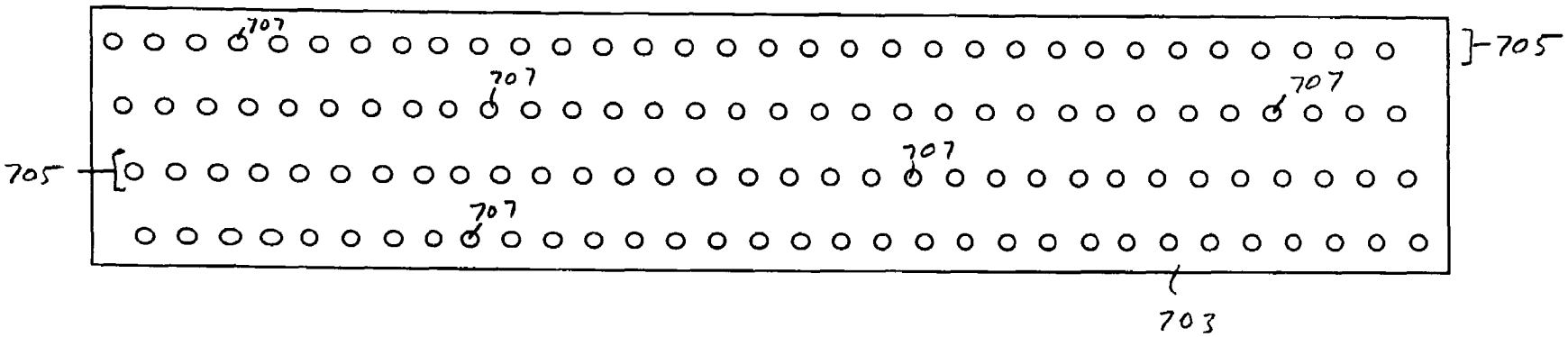
FIG. 7 is a top view of a four row staggered sensor array.

With reference to FIG. 7, in an embodiment, an individual array 703 includes 128 sensors 707 that are located in four offset rows 705. The materials being detected would travel in a vertical direction across the array 703. Each row of sensors 705 runs across the width of the conveyor belt 701. In this embodiment, the sensors 707 may be mounted within counter bored holes that are 38 mm in diameter and 19 mm deep. The sensor holes are separated by a center to center distance of 72 mm within each row 705. Each row 705 is separated by a distance of 109 mm and the sensors 707 in the adjacent rows are offset by 18 mm. This configuration places sensors 707 across the entire width with some overlap between the sensors 707 and also provides sufficient separation to avoid cross talk between the sensors 707. During experimentation, identical high frequency 500 Hz sensors were used without any cross talk between sensors.

The sensors are able to detect all target materials that are placed over the 38 mm diameter counter bored hole that are within the detection range. In the described embodiment, there is some overlap between the counter bore hole diameters of the sensors rows across the width of the array that spans the parts path. Because there is overlap of sensors a small target materials piece may be detected by multiple sensors in different rows of the sensor array. The overlap can improve the performance of the system by adding some redundancy to the target material detection. The overlap may be quantified by a percentage. For example, a sensor array may have a 33% overlap if one third of each sensor is overlapped with another sensor. For a high level of redundancy, the overlap percentage can be 50% or higher, Adding more rows to the array, using larger diameter holes or placing the sensors closer together can increase the overlap.

After the fine stainless steel, aluminum/copper radiators, circuit boards, low conductive precious and semi-precious metals, lead, insulated wire and other nonconductive scrap pieces are sorted, they can be recycled. Although it is desirable to perfectly sort the mixed materials, there will always be some errors in the sorting process. The fine stainless steel, aluminum/copper radiators, circuit boards, low conductive precious and semi-precious metals, lead, insulated wire and other nonconductive scrap sorting algorithm may be adjusted based upon the detector signal strength. With analog sensors, a strong signal is a strong indication of metal while a weaker signal is less certain that the detected piece is metal. An algorithm sets a division of metal and non-metal pieces based upon signal strength and can be adjusted, resulting in varying the sorting errors. For example, by setting the metal signal detection level low, more non-metallic pieces will be sorted as metal. Conversely, if the metal signal detection level is high, more metallic pieces will not be separated from the non-metallic pieces. The metal recycling process can tolerate some non-metallic pieces, however this sorting error should be minimized. The end user will be able to control the sorting point and may even use trial and error or empirical result data to optimize the sorting of the mixed materials.

Although the described metal sorting system can have a very high accuracy resulting in metal sorting that is well over 90% pure metal, it is possible to improve upon this performance. There are various methods for improving the metal purity and accurately separating the fine nonferrous metals and insulated wire from mixed non-metallic materials at an accuracy rate close to 100%. The metal sorted as described above can be further purified by further sorting with an additional recovery unit. The recovery unit is similar to the primary metal sorting processing unit described above. The fine stainless steel, aluminum/copper radiators, circuit boards, low conductive precious and semi-precious metals, lead, insulated wire and other nonconductive scrap pieces sorted by the primary metal sorting unit are placed onto a second conveyor belt and scanned by additional arrays of inductive proximity detectors in the recovery unit. These recovery unit detector arrays can be configured as described above.

Like the primary sorting unit, the outputs of the inductive proximity detectors are fed to a computer which tracks the fine stainless steel, aluminum/copper radiators, circuit boards, low conductive precious and semi-precious metals, lead, insulated wire and other nonconductive scrap pieces. The computer transmits signals to the sorting mechanism to again separate the metal and nonmetal pieces into different bins at the end of the conveyor belt. In the preferred embodiment, the sorting system used with the recovery unit has air jets mounted under the plane defined by the upper surface of the conveyor belt. The air jets are not actuated when the non-metal pieces arrive at the end of the conveyor belt and they fall into the non-metal bin adjacent to the end of the conveyor. The recovery computer sends signals actuating the air jets when metal pieces arrive at the end of the conveyor belt deflecting them over a barrier into a metal bin. These under mounted air jets are preferred because the metal tends to be heavier and thus has more momentum to travel further to the metal bin than the lighter non-metal pieces. The resulting fine non-ferrous and insulated wire pieces that are separated by the recovery unit are at a very high metal purity of up to 99% and can be recycled without any possible rejection due to low purity.

Because the majority of the parts being sorted by the recovery unit are metal, there will be much fewer pieces sorted into the non-metal bin than the metal bin. Because there will be some metal pieces in the non-metal bin and the total volume will be substantially smaller than that in the metal bin, the pieces in the non-metal bin may be placed back onto the recovery unit conveyor belt and resorted. By passing the non-metals through the recovery unit multiple times, any metal pieces in this material will eventually be detected and placed in the metal bin. This processing insures the accuracy of the metal and non-metal sorting.

It will be understood that although the present invention has been described with reference to particular embodiments, additions, deletions and changes could be made to these embodiments, without departing from the scope of the present invention.

What is claimed is:

1. A sorting apparatus for sorting metal pieces from mixed materials comprising:

a surface for transporting the metals and the mixed materials;

a first array of inductive proximity sensors and a second array of inductive proximity sensors that produce electrical signals when the metals are detected within a detection range of the inductive proximity sensors;

a separation unit for separating the metals from the mixed materials; and a computer coupled to the plurality of inductive proximity sensors and the separation unit;

wherein a first array of inductive proximity sensors are mounted a first distance under the surface and a second array of inductive proximity sensors are mounted a second distance under the surface and the computer instructs the separation unit to separate the materials that have been detected by the first array of proximity sensors or the second array of proximity sensors from the mixed materials and wherein if a first metal piece is detected by the first array of inductive proximity sensors but not detected by the second group of inductive proximity sensors, the computer identifies the one piece as being a first type of metal and if a second metal piece is detected by the first array of inductive proximity sensors and also detected by the second array of inductive proximity sensors, the computer identifies the second piece as being a second type of metal.

2. The sorting apparatus of claim 1 wherein the computer instructs the separation unit to place the first piece in a first sorting bin and place the second piece in a second sorting bin.

3. The sorting apparatus of claim 1 wherein the separation unit includes an air jet array that is oriented across the width of the surface for transporting the metals and mixed materials and positioned adjacent to one end of the surface for transporting the metals and mixed materials.

4. The sorting apparatus of claim 1 further comprising:

a sensor plate comprising a wear resistant polymer with high abrasion factor and low coefficient factor having a plurality of counter bored holes;

wherein the first array of inductive proximity sensors are mounted in the plurality of counter bored holes.

5. The sorting apparatus of claim 1 wherein the surface for transporting the metals and the mixed materials is the upper surface of a conveyor belt that does not contain any carbon materials and has a known thickness.

6. The sorting apparatus of claim 1 wherein each of the inductive proximity sensors are mounted in holes and separated into staggered multiple rows that are offset so that the detection area of a sensor in a first row overlaps the detection area of a sensor in a second row by less than 80%.

7. The sorting apparatus of claim 1 wherein each of the inductive proximity sensors are mounted in holes and the first array of inductive proximity sensors includes a plurality of rows and the sensor detection areas of a first row are offset from the sensor detection areas of an adjacent row by more than 20%.

8. The sorting apparatus of claim 1 wherein the first array of inductive proximity sensors includes a first group of inductive sensors that operates at a first frequency and a second group of inductive sensors that operates at a second frequency that is different than the first frequency and the sensors of the first group are adjacent to the sensors of the second group.

* * * * *